US009107008B2

(12) United States Patent
Leitner

(10) Patent No.: US 9,107,008 B2
(45) Date of Patent: Aug. 11, 2015

(54) MICROPHONE WITH ADJUSTABLE CHARACTERISTICS

(75) Inventor: Stefan Leitner, Pfaffstätten (AT)

(73) Assignee: Knowles IPC(M) SDN BHD, Pulau Pinang (MY)

( * ) Notice: Subject to any disclaimer, the term of this patent is extended or adjusted under 35 U.S.C. 154(b) by 495 days.

(21) Appl. No.: 13/264,751

(22) PCT Filed: Apr. 15, 2010

(86) PCT No.: PCT/IB2010/051634

§ 371 (c)(1),
(2), (4) Date: Oct. 16, 2011

(87) PCT Pub. No.: WO2010/119415

PCT Pub. Date: Oct. 21, 2010

(65) Prior Publication Data

US 2012/0033831 A1 Feb. 9, 2012

(30) Foreign Application Priority Data

Apr. 15, 2009 (EP) ..... 09157977

(51) Int. Cl.

| | |
|---|---|
| ***H04R 9/08*** | (2006.01) |
| ***H04R 1/08*** | (2006.01) |
| ***H04R 19/04*** | (2006.01) |
| ***H04R 1/22*** | (2006.01) |
| *H04R 25/00* | (2006.01) |
| *H04R 19/00* | (2006.01) |

(52) U.S. Cl.

CPC ..... *H04R 19/04* (2013.01); *H04R 1/083* (2013.01); *H04R 1/222* (2013.01); *H04R 19/005* (2013.01); *H04R 2201/003* (2013.01); *H04R 2410/07* (2013.01)

(58) Field of Classification Search

CPC ..... H04R 1/083; H04R 1/222; H04R 19/005; H04R 19/04; H04R 2201/003; H04R 2410/07

USPC ..... 381/355–369, 98, 170–182, 423–429

See application file for complete search history.

(56) References Cited

U.S. PATENT DOCUMENTS

| | | | | |
|---|---|---|---|---|
| 2003/0194103 | A1* | 10/2003 | Kakinuma | 381/361 |
| 2006/0006483 | A1 | 1/2006 | Lee et al. | |
| 2008/0304681 | A1* | 12/2008 | Langlois et al. | 381/174 |

FOREIGN PATENT DOCUMENTS

| | | | |
|---|---|---|---|
| CN | 1589587 | A | 3/2005 |
| CN | 101321408 | B | 12/2008 |

OTHER PUBLICATIONS

International Search Report and Written Opinion for International Patent Application PCT/IB/2010/051634 (Jul. 6, 2010).

Chinese Patent Office, First Office Action and Search Report, with English Translation, Jan. 19, 2014.

* cited by examiner

*Primary Examiner* — Vivian Chin
*Assistant Examiner* — Ammar Hamid
(74) *Attorney, Agent, or Firm* — Steven McMahon Zeller; Dykema Gossett PLLC

(57) ABSTRACT

A microphone comprises a movable diaphragm 2 and a back electrode 4. The mechanical relationship between the back electrode 4 and the diaphragm 2 is adjustable thereby to control the cut-off frequency of the microphone. This enables the microphone to be adapted to different noise environments.

11 Claims, 3 Drawing Sheets

MICROPHONE WITH ADJUSTABLE CHARACTERISTICS

CROSS REFERENCE TO RELATED APPLICATIONS

This application is a National Phase of PCT International Application No. PCT/IB2010/051634, filed Apr. 15, 2010, which claims priority under 35 U.S.C. §119 to European Patent Application No. 09 157 977.1 filed Apr. 15, 2009, the entire disclosures of which are herein expressly incorporated by reference.

This invention relates to a microphone, and is concerned in particular with a microphone that can have its acoustic characteristics tuned according to the acoustic application.

One example of microphone which is suitable for miniaturisation is a condenser microphone. This comprises a thin membrane or diaphragm that is mounted in close proximity to a back electrode. The thin membrane is fixed at its edges, so that it is able to deflect when sound pressure is acting on it. Together, the membrane and the back electrode form an electric capacitor, where the capacitance changes according to the deflection of the membrane.

In use, the capacitor is charged using a DC voltage, usually called the polarization or bias voltage. When the capacitance varies due to a varying sound pressure, an AC voltage that is proportional to the sound pressure is superimposed on the DC voltage, which AC voltage is used as an output signal of the microphone.

The ever decreasing size of electronic devices has now lead to so-called MEMS (Micro Electro-Mechanical Systems) microphones. These microphones are usually developed for a lower voltage than standard microphones, normally for a voltage below 10V, and they have a very small air gap, usually less than 5 μm so as to obtain a sufficient field strength for an acceptable sensitivity of the microphone.

Figure 1A:
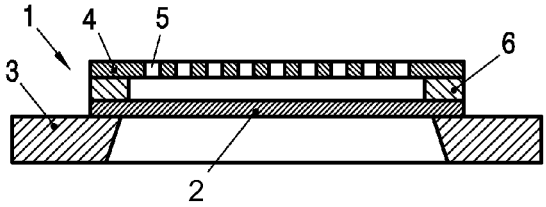

FIG. 1*a* shows a cross section of a prior art MEMS microphone 1. A silicon die 3 is coated with a conductive layer, which forms the membrane 2 (i.e. the microphone diaphragm). After this coating, a cavity is etched into the die 3, thus freeing the membrane 2. On top of this construction is placed a back electrode 4 comprising holes 5, wherein an insulator 6 electrically separates the membrane 2 from the back electrode 4. Optionally, the membrane 2 is made of an insulator. In this case, a conductive layer on or under the membrane is used as an electrode. This conductive layer may also serve as shielding against electromagnetic interference.

Figure 1B:
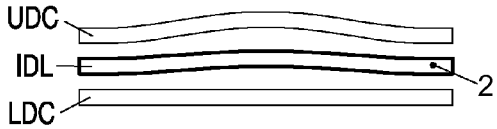

In use, a polarization voltage is applied to the membrane 2 and the conducting back plate 4, thus mechanically preloading and therefore bending the membrane 2. The membrane 2 illustrated in the middle of FIG. 1*b* indicates the idle position IDL after biasing the system by means of a polarization voltage. Varying air pressure in front of or behind the membrane 2 caused by sound waves leads to a further bending of the membrane 2. FIG. 1*b* also shows the upper and lower dead centre positions UDC and LDC of the membrane 2 for a given sound pressure. The three positions of the membrane 2 are separated for better visualization. In reality the outer area of the membrane is fixed and does not move so that there is only a bending within the membrane 2.

The holes 5 in the back electrode 4 serve as necessary ventilation. Otherwise, the membrane 2 when moving up would compress the air between membrane 2 and back plate 4, which would hinder the movement of the membrane 2.

Figure 2A:
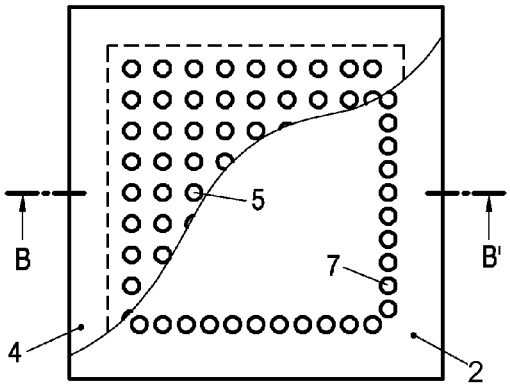

A certain stress within the membrane 2 is a result of the production process, and this means the idle position of the membrane 2 is unknown. As a consequence, there can be a large spread of the sensitivity for different microphones. Therefore the membrane 2 may have small holes in the outer area, thereby decreasing the stress within the membrane 2. FIG. 2*a* shows a top view of such a membrane 2, with the upper left corner showing the back electrode 4 with holes 5, and in lower right corner showing the membrane 2 with holes 7.

Figure 2B:
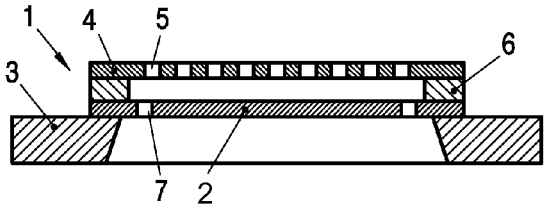

FIG. 2*b* shows a corresponding cross sectional view B-B' of the microphone 1. The size of the holes 7 may not exceed a certain diameter because otherwise the ventilation through these holes 7 is too high, thereby decreasing the sensitivity of the microphone 1. In some solutions therefore these holes 7 are sealed again with a different material, which does not influence the stress within the membrane 2 but only closes the holes 7.

This invention is concerned specifically with the acoustic performance of the microphone. One key parameter of a microphone is its lower cut-off frequency. Below this cut-off frequency the sensitivity of the microphone shows significant decrease. The desired lower cut-off frequency of the microphone is determined by:

- the mechanical parameters such as compliance, mass and damping of the sensor;
- the electrical parameters of the readout electronics; and
- the acoustic application such as setup of the pressure equalisation mechanism.

Essentially, the microphone is less sensitive for frequencies below the cut-off frequency $f_C$.

An example of an acoustic application having particular requirements is in environments where wind noise is expected. This is a challenging environment for microphone recordings, as wind noise has high amplitudes, especially at low frequencies.

Different requirements can thus arise for a microphone. It is beneficial to have a wide frequency response (including low frequency content) for most recording situations, including any high quality recordings. However, recordings under difficult conditions (e.g. wind noise) should deliver undistorted results.

It is possible to process the signals captured by the microphone in software, for example to apply filtering which is selected according to the particular acoustic environment. However, when a distorted output is provided by the microphone itself, the signal processing may not be successful in recovering the desired signal.

According to the invention, there is provided a microphone comprising a sensor having a movable electrode and a back electrode, wherein the movable electrode comprises a diaphragm which is spaced from the back electrode, wherein the microphone further comprises adjusting means, wherein the physical relative lateral alignment between the back electrode and the diaphragm is adjustable by the adjusting means thereby to control a cut-off frequency of the microphone.

The invention thus provides a microphone that adaptively controls the cut-off frequency fc. A low fc value is enabled for standard conditions, and a high fc value is enabled for high wind noise conditions or other low frequency noise conditions. The adjusting means is part of the microphone design and is operated during use of the microphone to adapt the microphone configuration as required. Thus, the adjustment is possible after manufacture rather than part of a design optimisation during manufacture. The adjustment in use can be automated (for example dependent on ambient noise levels) or there can be settings for selection by the user.

The movable electrode comprises a diaphragm, with the diaphragm and the back electrode spaced by a spacer arrangement. This defines a condenser microphone arrangement, which is suitable for miniaturised implementation using MEMS technology. In a condenser microphone, the sensor is basically a capacitor with one stiff and one flexible electrode.

The adjustment does not increase the thickness of the microphone arrangement, by providing lateral adjustment.

The back electrode preferably comprises an array of vent openings. These are used to enable free movement of the diaphragm. The diaphragm preferably also comprises a plurality of openings, and it is the alignment or misalignment of openings that can then be used to tune the acoustic properties of the microphone.

Thus, the alignment can be adjustable between at least:

a first alignment between the back electrode and the diaphragm in which at least some of the diaphragm openings are aligned with vent openings of the back electrode; and a second alignment between the back electrode and the diaphragm in which said at least some of the diaphragm openings are aligned with solid portions of the back electrode.

The first alignment then corresponds to a high cut-off frequency (for conditions with large amounts of low frequency noise, such as wind) and the second alignment corresponds to a low cut-off frequency (for full sensitivity).

The diaphragm and sensor can be rotatable with respect to each other to adjust the mechanical relationship, and the actuator is provided for controlling the rotation.

The invention also provides a method of adjusting the frequency response of a microphone comprising a sensor having a movable electrode and a back electrode wherein the movable electrode comprises a diaphragm which is spaced from the back electrode, the method comprising using adjusting means to adjust the physical relative lateral alignment between the back electrode and the diaphragm thereby to control a cut-off frequency of the microphone.

An example of the invention will now be described in greater detail with reference to the accompanying drawings, in which:

FIG. 1*a* shows a cross sectional view of a prior art MEMS condenser microphone;

FIG. 1*b* shows the bending of the membrane of FIG. 1*a;*

FIG. 2*a* shows a top view of a prior art membrane with stress release structures;

FIG. 2*b* shows the cross sectional view of the membrane of FIG. 2*a;*

Figure 3A:
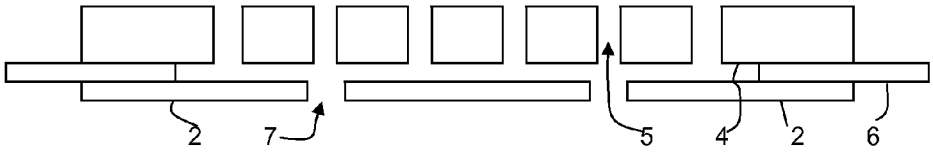
Figure 3B:
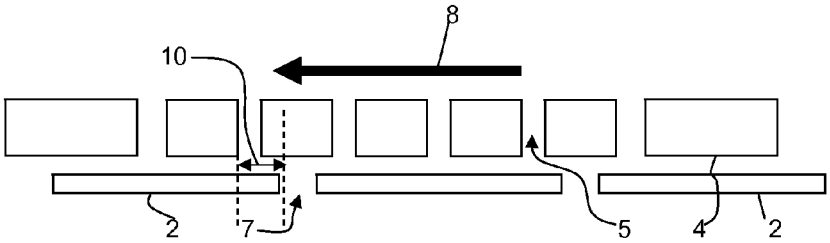

FIGS. 3*a* and 3*b* show a microphone of the invention; and

Figure 4A:
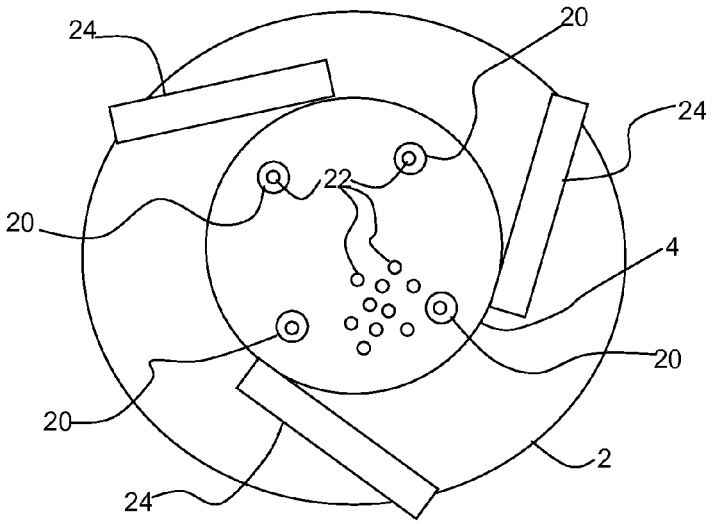
Figure 4B:
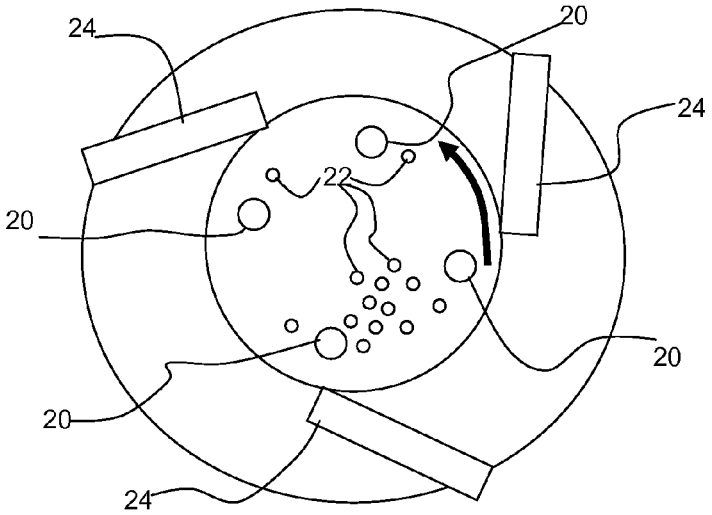

FIGS. 4*a* and 4*b* show one possible way to adjust the microphone characteristics.

The invention provides a microphone with mechanical control of the cut-off frequency. Different cut-off frequencies are for example desired for different noise conditions.

FIG. 3*a* shows a microphone of the invention, and only shows the movable electrode (diaphragm), back electrode and spacer. As for the example of FIG. 2*b*, the back electrode 4 has vent openings 5 and the diaphragm has openings 7. The back electrode and movable electrode together define a sensor.

In the position shown in FIG. 3*a*, the openings 7 are aligned with the openings 5. It has been found that this reduces the low frequency responsiveness, and thereby acts as a mechanical high pass filter, which increases the cut-off frequency.

The invention is based on the recognition that the alignment of openings can be used to tune the electro-acoustic characteristics of the microphone. This alignment can be varied by changing the relative lateral alignment between the back electrode 4 and the diaphragm 2.

FIG. 3*a* thus can be considered to show a first alignment configuration between the back electrode 4 and the diaphragm 2 in which the diaphragm openings 7 are aligned with the vent openings 5. This corresponds to a high cut-off frequency.

FIG. 3*b* shows a second alignment configuration between the back electrode 4 and the diaphragm 2 in which the diaphragm openings 7 are aligned (partially or fully) with solid portions of the back electrode 4. This corresponds to a low cut-off frequency.

The typical diameter of the vent openings 5 is around 1 μm, and the diaphragm openings 7 may be the same size, or slightly larger (as there will be less of them) for example around 2 μm. The spacing between the diaphragm and the back electrode is around 2 μm, or preferably at least in the range 1 μm to 10 μm.

The movement required in the direction of arrow 8 is thus of the order of 2 μm to 20 μm (shown as arrow 10 in FIG. 3*b*). The movement is therefore preferably electrically controlled using MEMS technology devices.

The diaphragm 2 and back electrode 4 can for example be rotatable with respect to each other to adjust the mechanical relationship. Control of the rotation is by means of an actuator which can use the piezoelectric effect, bimetal effect, thermal expansion or other effects that provide a physical change in position under electrical control.

The number and position of the openings in the diaphragm and in the back electrode are chosen to provide the desired acoustic characteristics in the two modes.

For example, the number of openings in the membrane may be in the range 1 to 100, more preferably 4 to 10, whereas the number of openings in the back electrode is higher, for example of the order of hundreds or thousands, for example 100 to 20000, or more preferably 1000 to 20000.

The diaphragm openings are typically symmetrically placed, whereas the back electrode openings can be randomly spaced.

FIG. 4 shows one possible way to adjust the microphone characteristics when the position adjustment is based on rotation.

The membrane 2 has four openings 20, and a few of the openings 22 of the back electrode 4 are also shown. The membrane and back electrode can be rotated with respect to each other. In the orientation shown in FIG. 4*a*, the four membrane openings are aligned with openings of the back electrode, whereas in the orientation shown in FIG. 4*b*, the four membrane openings are not aligned with any openings of the back electrode.

The membrane is formed as a component fixed in a frame, in the form of a kettle drum. The membrane and back electrode are coupled together by fixtures 24 which can be controlled to change length by means of a piezoelectric or thermal effect. This effect is shown in FIG. 4, in which the fixtures 24 are shorter in FIG. 4*b* than in FIG. 4*a*.

There are many possible MEMS actuators for controlling the small scale relative movement between the diaphragm and the back electrode. A number of possible technologies is described in the article "Scaling Laws of Microactuators and Potential Applications of Electroactive Polymers in MEMS" (Proceedings of SPIE's 6th International Symposium on Smart Structures and Materials, 1-5 Mar. 1999, Paper No. 3669-33, by Chang Liu and T Bar-Cohen). This article outlines the function of MEMS transverse comb drive actuators, MEMS lateral comb drive actuators, magnetically actuated devices, and thermal bimetallic actuators and piezoelectric actuators.

These different technologies can all be used to implement the desired relative movement. A linear movement can be used directly to provide the desired change in alignment, or this linear movement can be converted into a rotational movement in the manner explained with reference to FIG. 4.

There may be multiple modes, not only the two modes described above.

The invention has been described in connection with a MEMS capacitor microphone. However, the invention can applied to other microphone designs (such as dynamic microphones, electret microphones, piezoelectric microphones, carbon microphones). The concept underlying the invention is to provide mechanical adjustment of the microphone configuration in order to change the electrical characteristics.

The invention provides improved audio performance during difficult environmental conditions. By implementing the adjustment at the level of the microphone sensor, power savings can be obtained, as the amount of filtering and other signal processing to compensate for the noise to be filtered can be reduced.

The adjusting means is in the preferred embodiment a MEMS actuator. However, the adjustment may be made by other micro actuators, or it could even be manual.

Various modifications will be apparent to those skilled in the art.

The invention claimed is:

1. A microphone comprising a sensor having a movable electrode and a back electrode, wherein the movable electrode comprises a diaphragm which is spaced from the back electrode, wherein the microphone further comprises adjusting means, wherein the physical relative lateral alignment between the back electrode and the diaphragm is adjustable by the adjusting means thereby to control a cut-off frequency of the microphone.

2. A microphone as claimed in claim 1, wherein the back electrode comprises an array of vent openings.

3. A microphone as claimed in claim 2, wherein the movable electrode comprises a plurality of openings.

4. A microphone as claimed in claim 1, wherein the alignment is adjustable between at least:

a first alignment between the back electrode and the movable electrode in which at least some of the movable electrode openings are aligned with vent openings of the back electrode; and a second alignment between the back electrode and the movable electrode in which said at least some of the movable electrode openings are aligned with solid portions of the back electrode.

5. A microphone as claimed in claim 4, wherein the first alignment corresponds to a high cut-off frequency and the second alignment corresponds to a low cut-off frequency.

6. A microphone as claimed in claim 1, wherein the movable electrode and back electrode are rotatable with respect to each other to adjust the alignment.

7. A microphone as claimed in claim 6, wherein the adjusting means is for controlling the rotation.

8. A microphone as claimed in claim 7, wherein the adjusting means comprises a MEMS actuator.

9. A method of adjusting the frequency response of a microphone comprising a sensor having a movable electrode and a back electrode wherein the movable electrode comprises a diaphragm which is spaced from the back electrode, the method comprising adjusting the physical relative lateral alignment between the back electrode and the diaphragm by an adjustment means to control a cut-off frequency of the microphone.

10. A method as claimed in claim 9, wherein the adjusting comprises rotating the movable electrode and back electrode with respect to each other to adjust the lateral alignment.

11. A method as claimed in claim 9, wherein the adjusting is carried out by a MEMS actuator.

* * * * *